US008418894B2

(12) United States Patent
Gouldson

(10) Patent No.: US 8,418,894 B2
(45) **Date of Patent: *Apr. 16, 2013**

(54) GARMENT HANGER WITH LOWER NECK INDICATOR

(75) Inventor: Stanley F. Gouldson, Northport, NY (US)

(73) Assignee: Spotless Plastics Pty. Ltd., Melbourne, Victoria (AU)

( * ) Notice: Subject to any disclaimer, the term of this patent is extended or adjusted under 35 U.S.C. 154(b) by 188 days.

This patent is subject to a terminal disclaimer.

(21) Appl. No.: 12/956,905

(22) Filed: Nov. 30, 2010

(65) Prior Publication Data

US 2012/0132679 A1 May 31, 2012

(51) Int. Cl.
*A41D 27/22* (2006.01)
*A47G 25/00* (2006.01)

(52) U.S. Cl.
USPC ..... 223/85

(58) Field of Classification Search ..... 223/85–94; D6/328
See application file for complete search history.

(56) References Cited

U.S. PATENT DOCUMENTS

| | | | | |
|---|---|---|---|---|
| 4,892,237 | A | 1/1990 | Duester et al. | |
| 4,997,114 | A | 3/1991 | Petrou | |
| 5,096,101 | A | 3/1992 | Norman et al. | |
| 5,503,310 | A | 4/1996 | Zuckerman et al. | |
| 7,240,813 | B1 | 7/2007 | Goldman | |
| 7,513,400 | B2 * | 4/2009 | Gouldson | 223/85 |
| D605,415 | S * | 12/2009 | Zuckerman et al. | D6/328 |
| 7,766,198 | B2 * | 8/2010 | Mainetti | 223/85 |
| D625,114 | S * | 10/2010 | Gouldson | D6/328 |
| 7,922,047 | B2 * | 4/2011 | Gouldson | 223/85 |
| 8,141,756 | B2 * | 3/2012 | Mainetti | 223/85 |
| 2005/0115993 | A1 | 6/2005 | Miura | |
| 2006/0006204 | A1 | 1/2006 | Mainetti | |
| 2006/0213938 | A1 | 9/2006 | Gouldson | |
| 2007/0062984 | A1 | 3/2007 | Louw | |
| 2007/0090134 | A1 | 4/2007 | Wu | |
| 2007/0175932 | A1 | 8/2007 | Wu | |
| 2007/0199963 | A1 | 8/2007 | Gouldson | |

(Continued)

FOREIGN PATENT DOCUMENTS

| | | |
|---|---|---|
| AU | 509043 | 6/1979 |
| DE | 203 13 340 U 1 | 12/2003 |
| GB | 2461972 A | 1/2010 |

OTHER PUBLICATIONS

United Kingdom Search Report dated May 20, 2010 for Application No. GB1000818.3.
United Kingdom Search Report dated Jan. 21, 2011 for Application No. GB1000818.3.

(Continued)

*Primary Examiner* — Ismael Izaguirre
(74) *Attorney, Agent, or Firm* — Scully, Scott, Murphy & Presser, P.C.

(57) ABSTRACT

In a combination of an intimate apparel hanger and an indicator for displaying garment-related information, the indicator is mounted to a lower neck region of the hanger where the hanger hook intersects the hanger body. The hanger has a flange, having a sloped surface and an undersurface. The indicator has a resilient tab disposed in a wall of the indicator body. The resilient tab is outwardly displaced by the sloped surface to expand the top opening of the indicator to allow the indicator to pass over the flange. The undersurface of the flange retains the indicator at the lower neck region after the indicator passes over the flange.

37 Claims, 9 Drawing Sheets

U.S. PATENT DOCUMENTS

| | | | |
|---|---|---|---|
| 2007/0272716 | A1 | 11/2007 | Wu |
| 2009/0120973 | A1 | 5/2009 | Ho |
| 2009/0277933 | A1 | 11/2009 | Goldman et al. |
| 2010/0237109 | A1 | 9/2010 | Gouldson |

OTHER PUBLICATIONS

United States Office Action dated Jun. 9, 2010 for U.S. Appl. No. 12/406,501.

* cited by examiner

GARMENT HANGER WITH LOWER NECK INDICATOR

CROSS-REFERENCE TO RELATED APPLICATIONS

This present application is a continuation-in-part of co-pending U.S. patent application Ser. No. 12/406,501, filed Mar. 18, 2009, which is hereby incorporated by reference for all purposes.

BACKGROUND OF THE INVENTION

1. Field of Invention

The present invention relates generally to the field of garment hangers as are widely used for the purpose of shipping and displaying garments, and more particularly to a combination of a plastic molded garment hanger, such as an intimate apparel hanger, and a size indicator attached to the hanger at a lower neck region of the hanger.

2. Description of Related Art

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale.

In particular, retailers have specified particular hangers or hanger characteristics among suppliers in order to achieve uniformity on their sales floors. To this end, standards as to hanger size, shape, performance characteristics, etc., are maintained, for example, by organizations such as the Voluntary Inter-industry Commerce Standards Association (VICS). Intimate apparel hangers, pinch grip hangers, top garment hangers and so on are among the standardized hangers under the VICS standards.

Additionally, and interrelated to the promulgation of GOH programs, retailers and their customers desire to have the hanger itself display some indicia regarding the item carried upon it. Categories of indicia include manufacturer, material and price, but mostly the sizes of garments. Among the various means developed for accomplishing this, so-called lower neck indicators are widely applied and recognized in the industry. Lower neck indicators are secured to the hanger at or adjacent the intersection of the hook and the hanger body, to provide a displaying surface on which garment sizes are printed.

Normally, the lower neck indicators are secured to the hangers, either manually or automatically, at the manufacturers' cost. Thus, it is desirable in the industry to easily and quickly attach the indicators to the hangers. Accordingly, assembling efficiency can be improved and manufacturing cost of the hangers and the indicators can be reduced, which in turn offers a significant commercial advantage to the manufacturers, transporters, as well as retailers in the industry.

At the same time, it is also desirable in the industry to securely attach the indicators to the hangers. The reliable affixation of the indicators to the hangers in the GOH program prevents the indicators from accidentally and unintentionally moving and subsequently detaching from the hangers. Specifically, under industry standards, such as the VICS, it is required to maintain a certain degree of affixation of the indicator to the hanger to avoid young children from swallowing an indicator after the indicator is accidentally detached from a hanger, so as to provide so-called "child proof" hangers and sizers.

Accordingly, there is a need for improved garment hanger and indicator, which, in combination, enable easy and quick attachment of the indicator to the hanger while still maintaining a secure fixation of the indicator onto the hanger.

BRIEF SUMMARY OF THE INVENTION

Therefore, in order to overcome certain deficiencies of the prior art, provided according to one aspect of the present invention is a combination of a garment hanger and an indicator for displaying garment-related information. The hanger includes a hanger body and a hook extending upward from the body. The intersection of the hook and the hanger body defines a lower neck region of the hanger where the indicator is attached to the hanger. The hanger further includes at least a first flange projecting from the hook at a position distanced upward from the body of the hanger. The first flange includes a first sloped surface extending downward and away from the hook and a first undersurface extending away from the hook. The indicator is positioned at the lower neck region below the first undersurface of the first flange. The indicator includes an indicator body substantially surrounding the hook, and a top opening and a bottom opening defined at the topside and bottom side of the indicator, respectively. Specifically, the first undersurface of the first flange provides indicator-retaining interference with the indicator to retain the indicator at the lower neck region.

According to one embodiment of the present invention, the indicator body includes a pair of opposing sidewalls connected by a pair of opposing end walls to provide a substantially trapezoidal profile of the indicator. The indicator further includes at least a first resilient tab formed at the upper side of either a sidewall or an end wall. The first resilient tab is defined by a first pair of slots substantially bounding the sides of the first tab.

Preferably, the first resilient tab includes a first free upper end configured to engage the first sloped surface of the first flange to enlarge the top opening of the indicator to allow the indicator to pass over the first flange. The first free upper end is also configured to engage the first undersurface of the first flange once the indicator has passed over the first flange to retain the indicator at the lower neck region of the hanger.

Preferably, the first undersurface of the first flange is substantially horizontal. More preferably, the indicator further includes a first horizontal lip extending inwardly from the first resilient tab at the first free upper end, the first lip configured to engage the first sloped surface of the first flange to enlarge the top opening of the indicator to allow the indicator to pass over the first flange and to engage the first undersurface of the first flange once the indicator has passed over the first flange to retain the indicator at the lower neck region of the hanger.

According to another embodiment of the present invention, the hanger further includes a second flange projecting from the hook at a position distanced upward from the body of the hanger and opposite to the first flange. The second flange includes a second sloped surface extending downward and away from the hook and a second undersurface extending away from the hook. The indicator further includes a second resilient tab opposite the first resilient tab. The second resilient tab is formed at the upper side of either a sidewall or an end wall opposite the first resilient tab, and the second resilient tab is defined by a second pair of slots substantially bounding the sides of the second tab.

Preferably, the second resilient tab includes a second free upper end configured to engage the second sloped surface of the second flange to enlarge the top opening of the indicator to allow the indicator to pass over the second flange. The second free upper end is also configured to engage the second undersurface of the second flange once the indicator has passed over the second flange to retain the indicator at the lower neck region of the hanger.

Preferably, the second undersurface of the second flange is substantially horizontal. More preferably, the indicator further includes a second horizontal lip extending inwardly from the second resilient tab at the second free upper end. The second lip is configured to engage the second sloped surface of the second flange to enlarge the top opening of the indicator to allow the indicator to pass over the second flange and to engage the second undersurface of the second flange once the indicator has passed over the second flange to retain the indicator at the lower neck region of the hanger.

According to yet another embodiment of the present invention, the hanger further includes a third flange disposed under the first flange, and configured to be enclosed by the body of the indicator once the indicator has passed over the first flange. The third flange includes a third sloped surface extending downward and away from the hook. The third sloped surface of the third flange is configured to engage the interior of the first resilient tab, thereby preventing the indicator from moving horizontally against the third flange. Preferably, the third sloped surface of the third flange is configured to be complementary to the interior of the first resilient tab. More preferably, the inclination of the third sloped surface relative to a horizontal plane is substantially equal to the inclination of the first resilient tab relative to the horizontal plane.

Preferably, the indicator further includes a pair of notches formed at the lower ends of the end walls, respectively. The notches are dimensioned to be substantially complementary to the width of the hanger body to at least partially accommodate the hanger body, thereby preventing the indicator from moving laterally.

According to still another embodiment of the present invention, the hanger further includes a fourth flange disposed on the top surface of the hanger body. The fourth flange includes a fourth sloped surface, which is adapted to engage an inner surface of the indicator.

Preferably, the hanger hook includes an upright portion, which is substantially perpendicular to the hanger body, and a curved portion integral with the upright portion.

Preferably, the hook and the hanger body form an acute angle at one side of the hook and an obtuse angle at the other side of the hook.

According to another aspect of the present invention, provided is a garment hanger, specifically an intimate apparel hanger. The hanger includes a hanger body and a hook extending upward from the body. The intersection of the hook and the hanger body defines a lower neck region of the hanger where an indicator is attached to the hanger. The hanger further includes at least a first flange projecting from the hook at a position distanced upward from the body of the hanger. The first flange includes a first sloped surface extending downward and away from the hook and a first undersurface extending away from the hook. The first undersurface of the first flange provides indicator-retaining interference with the indicator to retain the indicator at the lower neck region. Preferably, the first undersurface of the first flange is substantially horizontal.

According to another embodiment of the present invention, the hanger further includes a second flange projecting from the hook at a position distanced upward from the body of the hanger and opposite to the first flange. The second flange includes a second sloped surface extending downward and away from the hook and a second undersurface extending away from the hook. Preferably, the second undersurface of the second flange is substantially horizontal.

According to yet another embodiment of the present invention, the hanger further includes a third flange disposed lower than the first undersurface of the first flange. The third flange includes a third sloped surface extending downward and away from the hook, for engaging an interior of an indicator.

According to still another embodiment of the present invention, the hanger further includes a fourth flange disposed on the top surface of the hanger body. The fourth flange includes a fourth sloped surface, which is adapted to engage an inner surface of the indicator.

Preferably, the hanger hook includes an upright portion, which is substantially perpendicular to the hanger body, and a curved portion integral with the upright portion.

Preferably, the hook and the hanger body form an acute angle at one side of the hook and an obtuse angle at the other side of the hook.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE INVENTION

Figure 1:
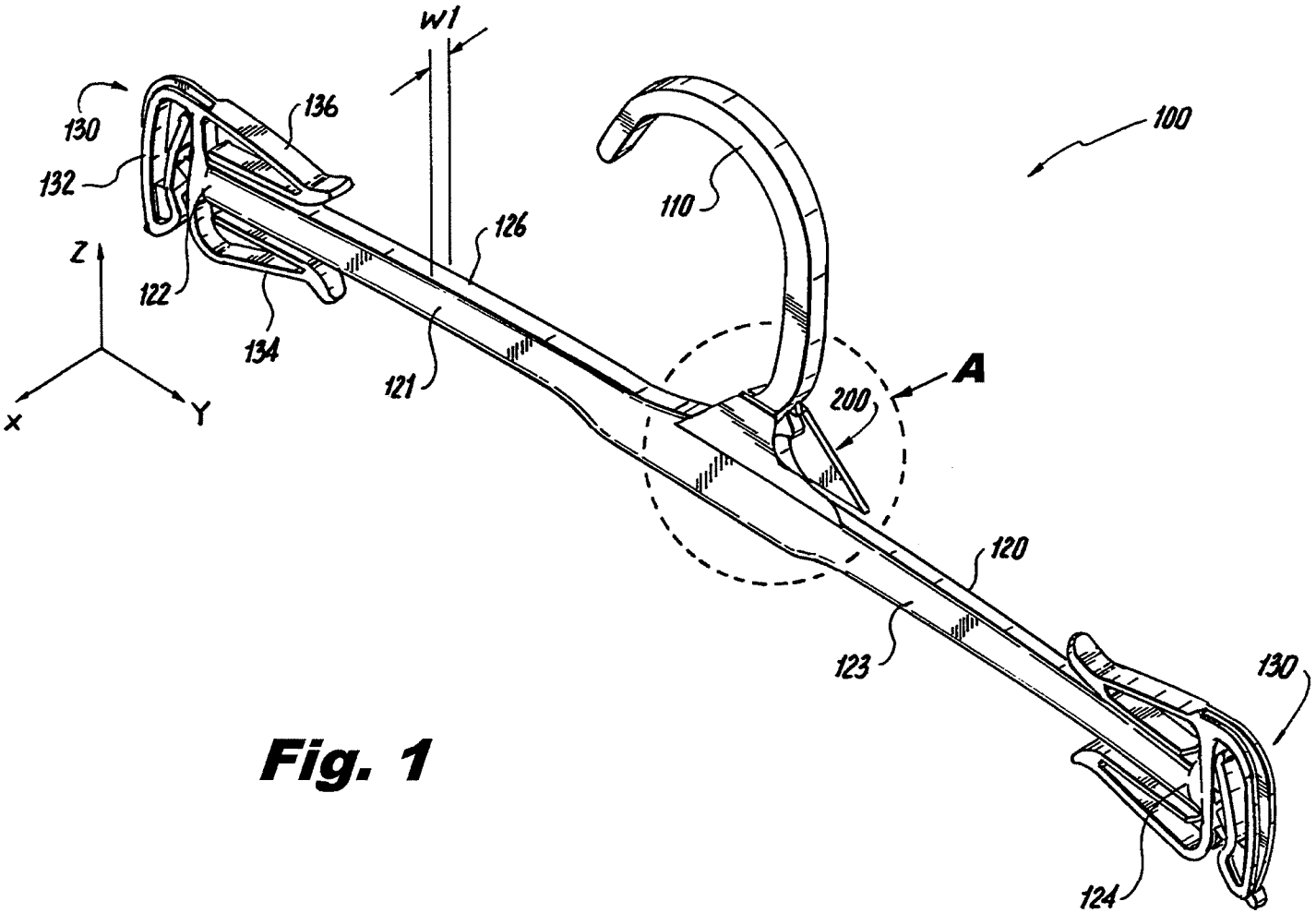
FIG. 1 illustrates a perspective of a combination of a garment hanger, such as an intimate apparel hanger, and an indicator, according to an exemplary embodiment of the present invention.
Figure 2:
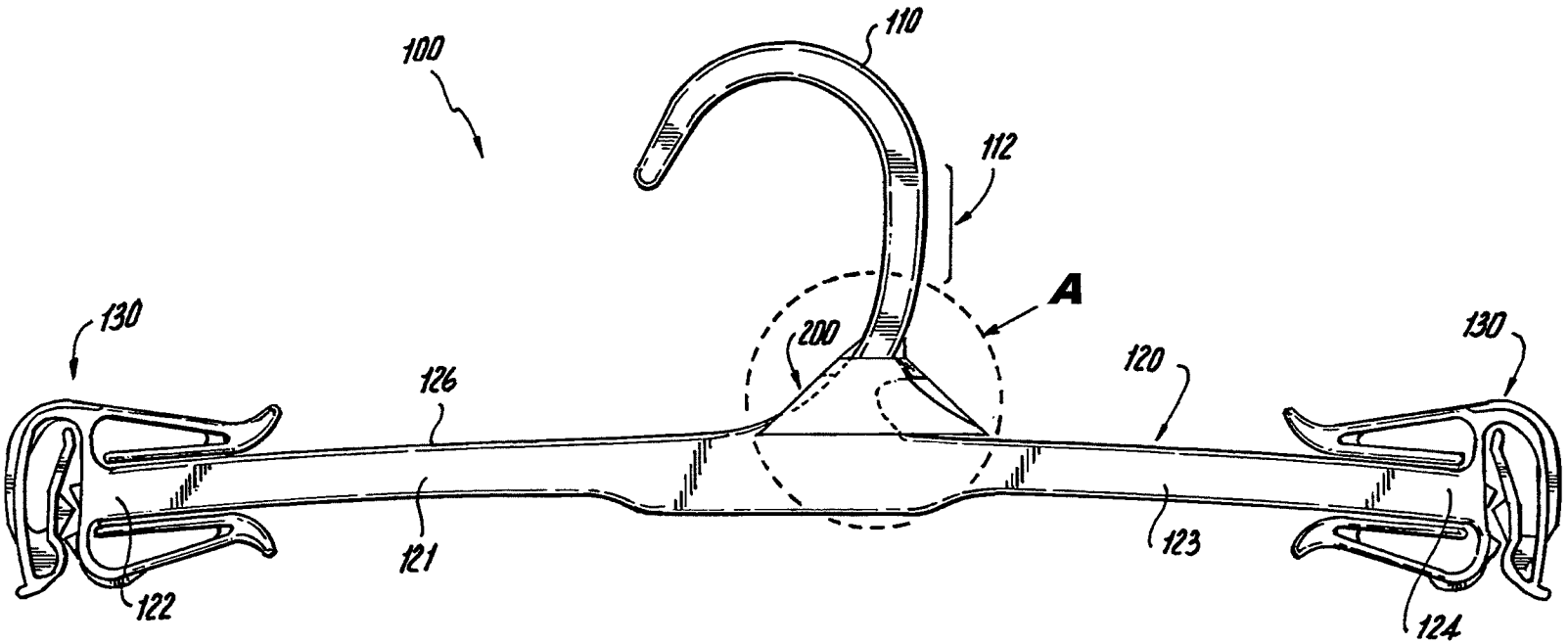
FIG. 2 illustrates a front elevation view of the combined shown in FIG. 1.

Referring now to FIGS. 1 and 2, illustrated is a combination of an intimate apparel hanger 100 and a lower neck indicator 200 attached to the hanger 100 for showing information related to a garment suspended by the hanger 100, such as the size of the garment.

The hanger 100 includes a hook 110 and a hanger body 120 connected to the hook 110. Preferably, the hook 110 is integrally molded to the hanger body 120 through a single plastic molding step. The intersection of the hook 110 and the hanger body 120 defines a lower neck region A, shown in FIGS. 1 and 2, where the indicator 200 is attached to the hanger 100. The hook 110 includes a substantially vertical part 112 above the lower neck region A, as shown in FIG. 2. The hanger body 120 can have any suitable configuration, such as a C-section beam, a reversed U-section beam, and so on.

The hanger body 120 includes a first arm 121 extending from the hook 110 to a first end 122 of the hanger body 120, and a second arm 123 extending oppositely from the hook 110 to a second end 124 of the hanger body 120. Preferably, the first arm 121 and the second arm 123 are substantially horizontal to provide a straight and elongated hanger body.

The hanger 100 further includes a pair of composite garment retaining clips 130 disposed at the first end 122 and the second end 124 of the hanger body 120, respectively. The composite clips 130 can assume any configuration suitable for retaining intimate apparel. In the shown embodiment, the clips 130 include a vertical garment retaining clip 132, attached to an end 122 of the body 120. The clips 130 further include a lower garment retaining clip 134, extending inwardly under the body 120 from the end 122 toward the hook 110, and an upper garment retaining clip 136, extending inwardly above the body 120 from the end 122 toward the hook 110.

In FIG. 1, a three-dimensional coordinate system is defined as shown. The hook 110 extends upward from the hanger body 120, substantially along the vertical Z-axis of the coordinate system. The hanger body 120 extends substantially along the horizontal Y-axis of the coordinate system to define a length of the hanger body 120 between the opposite ends 122 of the hanger body 120. Furthermore, along the lateral X-axis of the coordinate system, a first width W1 of the hanger body 120 is defined as the width of an upper surface 126 of the hanger body 120.

Figure 3:
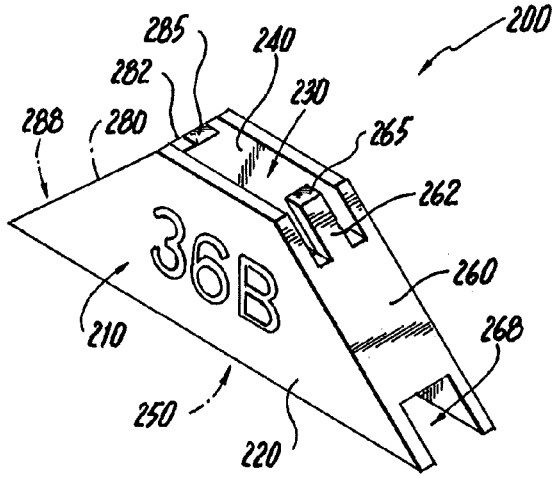
FIG. 3 illustrates a perspective view of the lower neck indicator shown in FIG. 1.

FIGS. 3-6 illustrate the structural details of the lower neck indicator 200. As shown in FIG. 3, the indicator 200 includes an indicator body 210, which substantially surrounds the hook 110 when the indicator 200 is attached to the hanger 100 at the lower neck region A. The indicator 200 further includes a top opening 230 and a bottom opening 250, formed at the topside and bottom side of the indicator 200, respectively. During the process of attaching the indicator 200 to the hanger 100 at the lower neck region A, the indicator 200 passes over the hook 110 through the top opening 230 and the bottom opening 250, and subsequently sits on the upper surface 126 of the hanger body 120. Preferably, the bottom opening 250 is larger than the top opening 230, and the top opening 230 of the indicator 200 is suitably dimensioned to allow the indicator 200 to pass over the hook 110 while providing certain interference with the hook 110 and/or any peripheral structures of the hook 110.

In the shown embodiment, the indicator body 210 includes an anterior sidewall 220 and an opposite posterior sidewall 240. The indictor 210 further includes a right end wall 260 and a left end wall 280, connecting the anterior sidewall 220 and the posterior sidewall 240 to form a continuous structure for the indicator body 210 to surround the hook 110 of the hanger 100.

Figure 4:
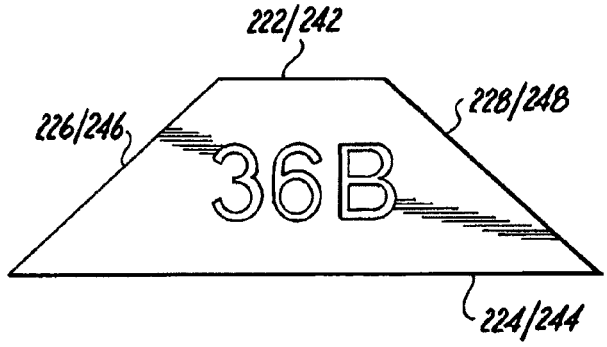
FIG. 4 illustrated a front elevation view of the indicator in FIG. 3.

As best shown in FIG. 4 illustrating a front elevation view of the indicator 200, the anterior sidewall 220 and the posterior sidewall 240 are substantially trapezoidal, to provide a substantially trapezoidal profile for the indicator 200. The anterior wall 220 and the posterior wall 240 are geometrically equal and symmetrical to one another. Thus, in the shown view, the sides of the anterior wall 220 and corresponding sides of the posterior wall 240 are overlapped.

The anterior sidewall 220 includes substantially parallel upper side 222 and lower side 224, and a pair of slanted sides 226 and 228. Symmetrically, the posterior sidewall 240 includes substantially parallel upper side 242 and lower side 244, and a pair of slanted sides 246 and 248. The trapezoidal profile of the indicator 200 provides a large displaying area.

The top opening 230 and the bottom opening 250 of the indicator 200, shown in FIG. 3, are substantially defined by the sidewalls 224 and 240 and the end walls 260 and 280, at the top side and bottom side of the indicator 200, respectively. The upper side 222 of the anterior sidewall 220 and the upper side 242 of the posterior sidewall 240 are substantially in the same plane of the top opening 230.

Figure 5:
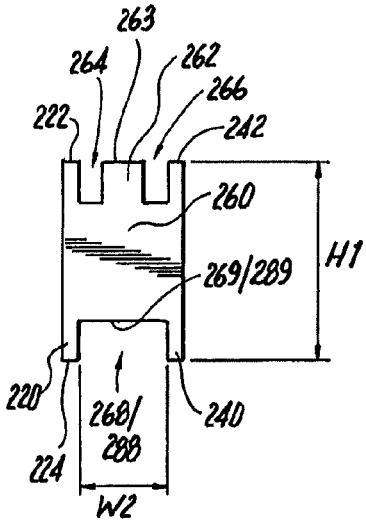
FIG. 5 illustrates a side view of the indicator in FIG. 3.

FIG. 5 illustrates a side view of the indicator 200 from the right end wall 260. The right end wall 260, connecting the anterior sidewall 220 and the posterior sidewall 240, includes a first resilient tab 262 substantially in a finger-like shape. The first resilient tab 262 terminates in a first free upper end 263, which is substantially in the same plane as the top opening 230 of the indicator 200. The first resilient tab 262 is defined and bounded by a first pair of slots 264 and 266, at the lateral sides of the right end wall 260, respectively. The first pair of slots 264 and 266 are substantially elongated slots parallel to one another, extending downwardly from the plane of the top opening 230 of the indicator.

The construction of the first pair of slots 264 and 266 bounding the first resilient tab 262 provides the first resilient tab 262 the ability to deflect outwardly to enlarge the top opening 230 under a biasing force and return inwardly to its original position when the bias force is withdrawn.

Although the above embodiment has been described with respect to a resilient tab formed in an end wall, it is understood by one of ordinary skill in the art that the resilient tab can be formed in a sidewall instead of the end wall or in both the sidewall and the end wall, depending on specific requirements and application circumstances of the indicator.

Figure 6:
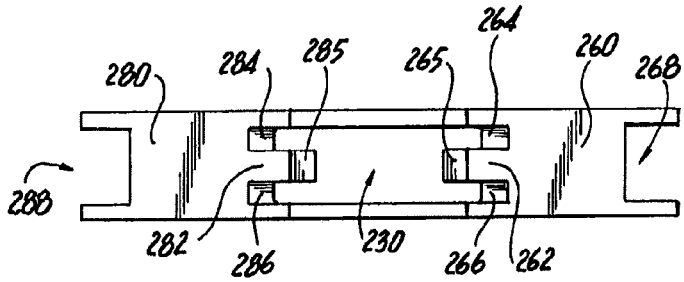
FIG. 6 illustrates a top view of the indicator in FIG. 3.

FIG. 6 illustrates a top view of the indicator 200. As shown in FIGS. 3 and 6, the indicator 200 further includes a second resilient tab 282 formed in the left end wall 280 of the indicator. The second resilient tab 282 is opposite to the first resilient tab 262 and substantially symmetrical to the first resilient tab 262.

The second resilient tab 282 terminates in a second free upper end 283, which is also substantially in the same plane as the top opening 230 of the indicator 200. The second resilient tab 282 is defined and bounded by a second pair of slots 284 and 286, at the lateral sides of the left end wall 280, respectively. The second pair of slots 284 and 286 are substantially elongated slots parallel to one another, extending downwardly from the plane of the top opening 230 of the indicator 200.

The construction of the second pair of slots 284 and 286 bounding the second resilient tab 282 provides the second resilient tab 282 the ability to deflect outwardly to further enlarge the top opening 230 under a biasing force and return inwardly to its original position when the bias force is withdrawn.

Accordingly, by deflecting outwardly the first resilient tab 262 and the second resilient tab 282 simultaneously, the top opening 230 of the indicator 200 can be enlarged to allow the indictor to pass over the hanger hook 110 and any peripheral structure of the hook 110.

As illustrated in FIGS. 3, 5 and 6, the indicator 200 further includes a first notch 268 below the right end wall 260 and a second notch 288 below the left end wall 280. The first notch 268 and the second notch 288 are in the form of a carve-out, extending upwardly from the lower side 224 of the anterior sidewall 220 and the lower side 244 of the posterior sidewall 240.

Preferably, the first notch 268 and second notch 288 are equal in their dimensions, having a second width W2 as shown in FIG. 5. The second width W2 is substantially equal to the first width W1 of the hanger body shown in FIG. 1. Thus, once the indicator 200 passes over the hook 110 of the hanger 100 to be positioned on the hanger body 120, the indicator 200 straddles on the hanger body 120, with the anterior sidewall 220 and the posterior sidewall 240 extending at either side of the hanger body 120. The straddling action of the indicator 200 on the hanger body 120 prevents the indicator 200 from moving laterally along the X direction, to provide a secure attachment of the indicator 200 to the hanger 100.

Furthermore, a first height H1 is defined for the indicator 200, as shown in FIG. 5, from the upper side 222 of the anterior sidewall 220 and the upper side 242 of the posterior sidewall 240 to the upper side 269 of the first notch 268 and the upper side 289 of the second notch 288.

Figure 8:
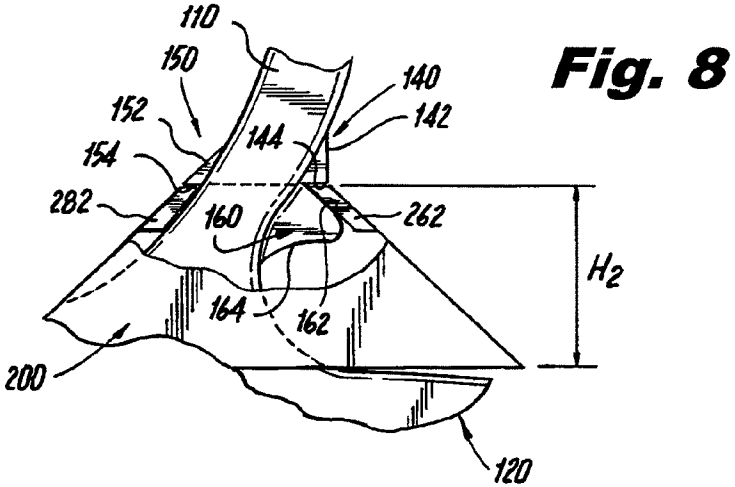
FIG. 8 illustrated an enlarged front elevation view of the combination shown in FIG. 7.
Figure 7:
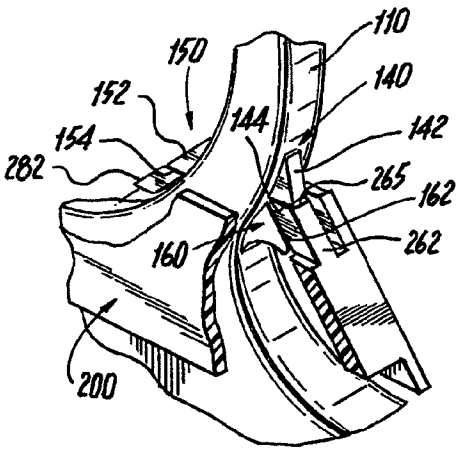
FIG. 7 illustrates an enlarged perspective of the combination in FIG. 1, at the lower neck region of the hanger indicated by the circle A in FIG. 1.

Referring to FIGS. 7 and 8, illustrating enlarged views of the combination of the hanger hook 110 and the indicator 200 at the lower neck region A, a detailed description of the mounting structure of the hanger 100 and the attachment of the indicator 200 to the hanger 100 will be made.

The hanger 100 includes a first flange 140 formed at the lower neck region A. The first flange 140 is dimensioned and configured to operatively engage and displace the first resilient tab 262 of the indicator 200, thereby enlarging the top opening 230 of the indicator 200 to allow the indicator 200 to pass over the first flange 140 and consequently retaining the indicator 200 at the lower neck region A.

Specifically, the first flange 140 is disposed to project from the hook 110 at a position distanced upward from the hanger body 120. The first flange 140 includes a first sloped surface 142 extending downward and away from the hook 110 and a first undersurface 144 extending away from the hook 110. The first sloped surface 142 is sloped with respect to the outer profile of the hook 110. During operation, when the indicator 200 passes over the substantially vertical part 112 of the hook 110 and approaches the lower neck region A of the hanger 100, the first resilient tab 262 comes into engagement with the first sloped surface 142. The interaction between the first sloped surface 142 and the first resilient tab 262 expands the top opening 230 of the indicator 200 by outwardly deflecting the resilient tab 262. With the expansion of the top opening 230, the indicator 200 continues to move downwardly until it passes over the sloped surface 142 of the fist flange 142. Specifically, during operation, the first free upper ends 263 of the first resilient tab 262 slides on the first sloped surface 142 to activate an outward deflection of the resilient tab 262. The first free upper end 263 flares out to enlarge the top opening 230 of the indicator 200.

Preferably, the sloped surface 142 is dimensioned and configured to follow the curvature of the hook 110 at the lower neck region A, thereby providing a smooth profile for flexing the resilient tab 262.

Once the first resilient tab 262 passes over the sloped surface 142, the tab returns to its original position, due to the resilience of the tab. Accordingly, the first resilient tab 262 comes into contact with the first undersurface 144 of the first flange 140. The first undersurface 144 provides indicator-retaining interference with the indicator 200 to retain the indicator at the lower neck region A of the hanger 100. Specifically, the first undersurface 144 serves as a retaining surface, holding the first resilient tab 162 under the first flange 140 and preventing the indicator 200 from moving upwardly along the Z direction.

The first undersurface 144 can assume any suitable configuration, such a curved surface or stepped surface, within the scope of the present invention, as long as it functions to hold the indicator 200 in the lower neck region A. Preferably, the first undersurface 144 is substantially horizontal. Preferably, referring back to FIGS. 3 and 6, the indicator 200 further includes a first horizontal lip 265 extending substantially horizontally from the first resilient tab 262 at the first free upper end 263 of the resilient tab 262. The first horizontal lip 265 engages the first sloped surface 142 of the first flange 140 to enlarge the top opening 230 of the indicator and subsequently engages the first undersurface 144 to retain the indicator 200 at the lower neck region A of the hanger 100. Specifically, the first horizontal lip 265 provides a complementary structure to a horizontal first undersurface 144, to offer the advantage of securely retaining in the indicator 200 at the lower neck region A.

The hanger 100 further includes a second flange 150, disposed oppositely to the first flange 140 and cooperates with the second resilient tab 282 of the indicator 200. Similarly, the second flange 150 projects from the hook 110 at a position distanced upward from the hanger body 120, at substantially the same height of the first flange 140.

The second flange 150 includes a second sloped surface 152 extending downward and away from the hook 110 and a second undersurface 154 extending away from the hook 110. The structural characterization and function of the second sloped surface 152 and the second undersurface 154 of the second flange 150 are similar to those of the first flange 140, and the description thereof is omitted for brevity.

Preferably, the second undersurface 154 is substantially horizontal. Preferably, referring back to FIGS. 3 and 6, the indicator 200 further includes a second horizontal lip 285 extending substantially horizontally from the second resilient tab 282 at the second free upper end 283. The second horizontal lip 285 engages the second sloped surface 152 of the second flange 150 to enlarge the top opening 230 of the indicator and subsequently engages the second undersurface 154 to retain the indicator 200 at the lower neck region A of the hanger 100. Specifically, the second horizontal lip 285 provides a complementary structure to a horizontal second undersurface 154, to offer the advantage of securely retaining the indicator 200 at the lower neck region.

Preferably, the first flange 140 and the second flange 150 are distanced from the hanger body 110 by a second height H2, defined from the first undersurface 144 and the second undersurface 154 to an upper surface 120 (FIG. 2) of the hanger body 110. Preferably, the second height H2 is substantially equal to the first height H1 of the indicator 200, as shown in FIG. 5. Thus, once the indicator 200 straddles on the hanger body 120, the indicator is substantially sandwiched by the flanges 140 and 150 and the hanger body 120. Accordingly, the movement of the indicator 200 along the vertical direction is prevented.

As shown in FIGS. 7 and 8, the hanger 100 further includes a third flange 160 disposed below the first flange 140, opposite to the first flange 140 along the vertical direction. The third flange 160 is configured to be substantially enclosed by the walls of the indicator 200, to prevent the indicator 200 from moving horizontally against the third flange 160, along the Y direction.

The third flange 160 includes a third sloped surface 162 extending downward and away from the hook 110. Preferably, the third sloped surface 162 is complementary to an interior of the indicator 200, specifically the inner side of the first resilient tab 262. More preferably, the third sloped surface 162 conforms to the inclination of the first resilient tab 262 and the right end wall 260 of the indicator 200, to maximize the contact and engagement between the first resilient tab 262 and the third sloped surface 162. Thus, the horizontal movement of the indicator 200 against the third flange 160 is prevented.

Figure 9:
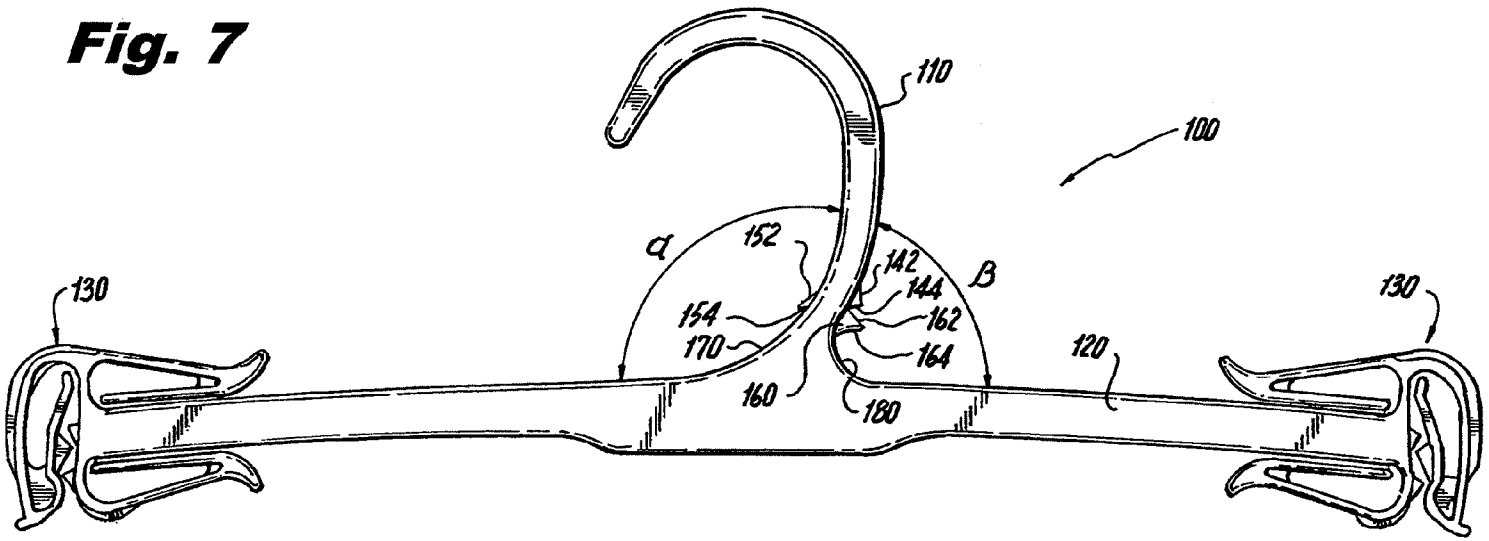
FIG. 9 is a front elevation view of the hanger shown in FIG. 1.

FIG. 9 illustrates an isolated front view of the hanger 100. Preferably, the hanger hook 110 is integrally molded with the hanger body 120, to provide an obtuse angle $\alpha$ at one side of the hook 110 and an acute angle $\beta$ at the other side of the hook 110. A first curve 170 is formed at one side of the hook 110 corresponding to the angle $\alpha$ and a second curve 180 is formed at the other side of the hook 110 corresponding to the angle $\beta$, at the lower neck region A, to provide smooth transitions between the hook 110 and hanger body 120.

Preferably, the first curve 170 is configured and dimensioned to cooperate with the third flange 160 to prevent the movement of the indicator 200 horizontally along the Y direction. More preferably, the first curve 170 is configured to be complementary to an interior of the indicator 200, specifically the inner side of the second resilient tab 282, such that the second resilient tab 282 substantially rests on the second curve 170 once the indicator 200 sits on the hanger body 120. Thus, the first curve 170 and the third flange 160, in combination, provide a mating structure enclosed by the indicator 200. The mating structure is dimensioned to be substantially complementary to the upper inner profile of the indicator 200 along the horizontal direction, defined by the first resilient tab 262 and the second resilient tab 282.

According to the present invention, due to the provision of the first flange 140 and the opposite second flange 150, the resilient tabs 262 and 282 of the indicator 200 are displaced outwardly to allow a user to easily and quickly mount the indicator 200 onto the hanger 100.

Due to the retaining undersurfaces of the first flange 140 and the second flange 150, the movement of the indicator 200 upwardly along Z direction is prevented. Furthermore, by setting the first height H1 of the indicator 200 substantially equal to the second height H2 of the hanger 100, the indicator 200 is substantially pinched by the flanges 140 and 150 and the hanger body 120. Accordingly, the indicator 200 is not movable along the Z direction.

The provision of the third flange 160, preferably in cooperation with the curved 170 at the intersection of the hook 110 and the hanger body 120, prevents the indicator 200 from moving horizontally along the Y direction.

In addition, the provision of the first notch 268 and the second notch 288 between the anterior sidewall 220 and the posterior sidewall 240, the width W2 of which are substantially equal to the width W1 of the hanger body 120, ensures that indicator 200 does not move laterally along the X direction.

Accordingly, the accidental and unintentional separation of the indicator 200 from the hanger 100 can be effectively avoided. The hanger and indicator combination according to the present invention is "Child Proof".

Figure 10:
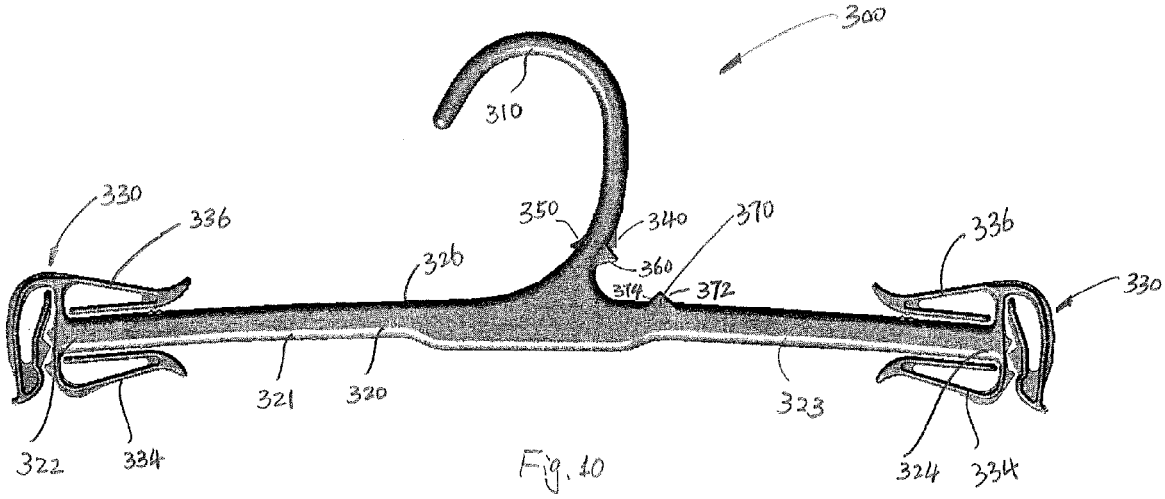
FIG. 10 is a front elevation view of a garment hanger according to another exemplary embodiment of the present invention.
Figure 11:
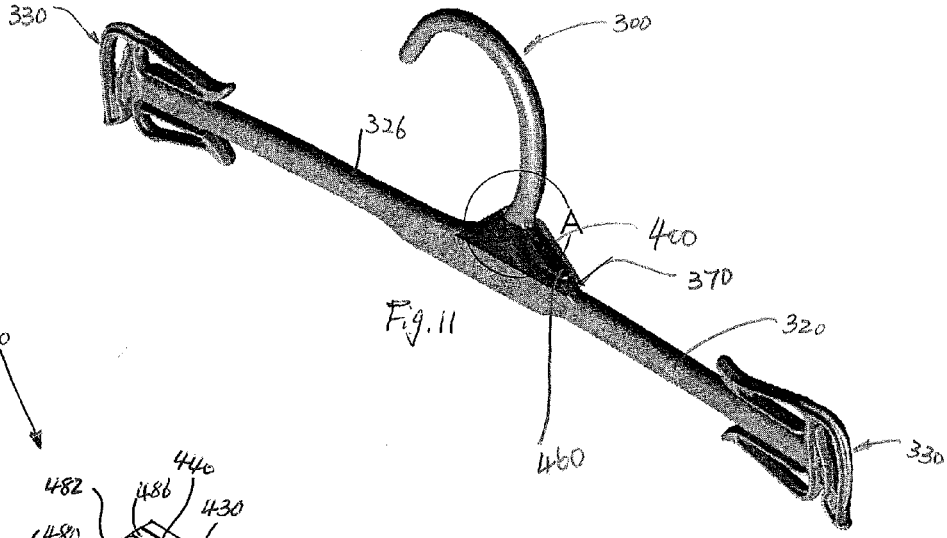
FIG. 11 is a perspective view of a combination of the garment hanger shown in FIG. 10 and a lower neck indicator attached to the hanger.

FIG. 10 is a front elevation view of a garment hanger 300, according to another exemplary embodiment of the present invention. FIG. 11 is a perspective view of a combination of the garment hanger 300 and a lower neck indicator 400 attached to the hanger for showing garment related information, such as the size of the garment. The hanger 300 includes a hook 310 and a hanger body 320 connected to the hook 310. The intersection of the hook 310 and the hanger body 320 defines a lower neck region A, where the lower neck indicator is attached to the hanger.

The hanger body 320 includes a first arm 321 extending from the hook 310 to a first end 322 of the hanger body 320, and a second arm 323 extending oppositely from the hook 310 to a second end 324 of the hanger body 320. Preferably, the first arm 321 and the second arm 323 are substantially horizontal to provide a straight and elongated hanger body. The hanger 300 further includes a pair of composite garment retaining clips 330 disposed at the first end 322 and the second end 324 of the hanger body 320, respectively. The composite clips 330 can assume any configuration suitable for retaining intimate apparel. In the shown embodiment, the clips 330 include a vertical garment-retaining clip 332, attached to an end 322 of the body 320. The clips 330 further include a lower garment retaining clip 334, extending inwardly under the body 320 from the end 322 toward the hook 310, and an upper garment retaining clip 336, extending inwardly above the body 320 from the end 322 toward the hook 310.

The hanger 300 includes a first flange 340 formed at the right side of the hanger hook 210, adjacent the lower neck region A. The hanger 300 further includes a second flange 350 formed at the left side of the hanger hook 310, which is disposed oppositely to the first flange 340. The hanger 300 further includes a third flange 360 formed at the right side of the hanger hook. The third flange 360 is disposed below the first flange 340, opposite to the first flange 340 along a vertical direction. The structure and operation of the flanges 340-360 are same or similar to that of the flanges 140-160 shown in the previous embodiment.

In this embodiment, the hanger 300 further includes a fourth flange 370 disposed on a top surface 326 of the hanger body 320. In the shown embodiment, the fourth flange 370 is shaped to have a substantially triangular profile extending upwardly from the top surface 326. The fourth flange 370 includes a first sloped surface 372 and a second sloped surface 374, extending oppositely with respect to each other. However, a person of ordinary skill in the art understands that the shape and profile of the fourth flange can vary without departing from the spirit of the present invention. For example, the fourth flange can have a curved profile having a curved surface.

Figure 12:
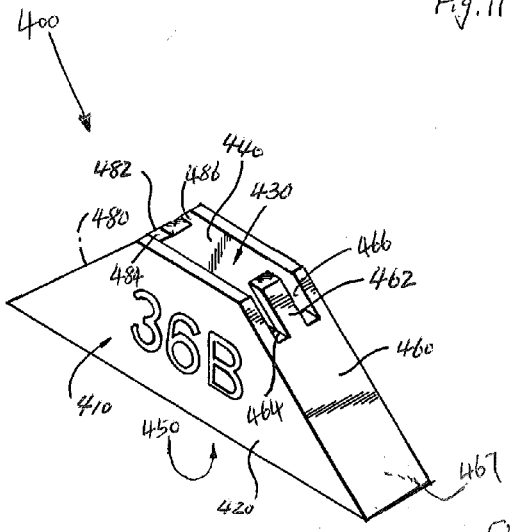
FIG. 12 is a perspective view of the lower neck indicator shown in FIG. 11.

FIG. 12 is a perspective view of the lower neck indicator 400 mounted to the hanger 300. The indicator 400 includes an indicator body 410, which substantially surrounds the hook 310 when the indicator 400 is attached to the hanger 300 at the lower neck region A. The indicator 400 further includes a top opening 430 and a bottom opening 450, formed at the topside and bottom side of the indicator 400, respectively. During the process of attaching the indicator 400 to the hanger 300 at the lower neck region A, the indicator 400 passes over the hook 310 through the top opening 430 and the bottom opening 450, and subsequently sits on the upper surface 326 of the hanger body 320. Preferably, the bottom opening 450 is larger than the top opening 430, and the top opening 430 of the indicator 400 is suitably dimensioned to allow the indicator 400 to pass over the hook 310 while providing certain interference with the hook 310 and/or any peripheral structures of the hook 310.

In the shown embodiment, the indicator body 410 includes an anterior sidewall 420 and an opposite posterior sidewall 440. The indicator body 410 further includes a right end wall 460 and a left end wall 480, connecting the anterior sidewall 420 and the posterior sidewall 440 to form a continuous structure for the indicator body 410 to surround the hook 310. For example, the anterior sidewall 420 and the posterior sidewall 440 can be substantially trapezoidal, to provide a substantially trapezoidal profile for the indicator body 410.

The right end wall 460 includes a first resilient tab 462, which is defined and bounded by a first pair of slots 464 and 466 formed at the top lateral sides of the right end wall 460, respectively. The first pair of slots 464 and 466 are substantially elongated slots parallel to one another. The first resilient tab 462 can deflect outwardly to enlarge the top opening 430 under a biasing force and return inwardly to its original position when the bias force is withdrawn.

Similarly, the left end wall 480 includes a second resilient tab 482, which is substantially symmetrical to the first resilient tab 462. The second resilient tab 482 is defined and bounded by a second pair of slots 484 and 486, at the lateral sides of the left end wall 480, respectively. The second pair of slots 484 and 486 are substantially elongated slots parallel to one another.

FIG. 11 shows a state after the lower neck indicator 400 is mounted to the hanger 300. In operation, the lower neck indicator 400 is handled to pass over the hook 310 to eventually sit on the top surface 326 of the hanger body 320, with the first flange 340 and the third flange 360 engaging the first resilient tab 462 and the second flange 350 engaging the second resilient tab 482, respectively.

In addition, the fourth flange 370 is properly distanced from the hook 310, such that, after the lower neck indicator 400 sits on the hanger body, the inner surface 467 of the right end wall 460 engages the right sloped surface 372 of the fourth flange 370. The engagement between the right end wall 460 and the fourth flange 370 enhances the stabilization of the lower neck indicator 400 on the hanger 300 by preventing the indicator from moving horizontally.

Figure 13:
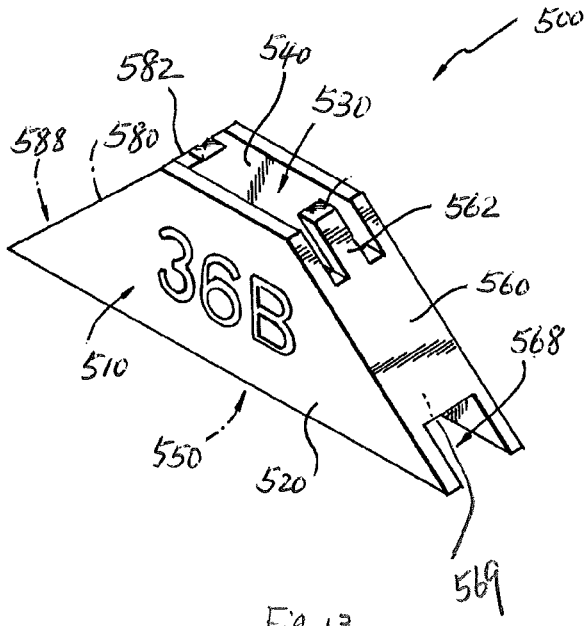
FIG. 13 is a perspective view of another lower neck indictor according to an embodiment of present application.

FIG. 13 illustrates a lower neck indictor 500 according to an alternative embodiment of present invention. The lower neck indicator 500 can be mounted to the hanger 300 shown in FIG. 10. The lower neck indicator 500 includes an indicator body 510 formed by an anterior sidewall 520, an opposite posterior sidewall 540, a right end wall 560 and a left end wall 580. The end walls connect the sidewalls to form a continuous structure for the indicator body 510 to surround the hook 310. The indicator body 510 defines a top opening 530 and a bottom opening 550. The indicator 500 further includes a first resilient tab 562 formed in the right end wall 560 and a second resilient tab 582 formed in the left end wall 580. The above components of the lower neck indicator 500 have same or similar structure as that of the lower neck indicator 400.

In addition, the lower neck indicator 500 further includes a first notch 568 formed in the bottom of the right end wall 560 and a second notch 588 formed in the bottom of the left end wall 580. Preferably, the first notch 568 and the second notch 588 are equal in their dimensions. The provision of the first and second notches allows the lower neck indicator 500 to straddle on the hanger body 320, with the anterior sidewall 520 and the posterior sidewall 540 extending at either lateral side of the hanger body 320, after the lower neck indicator 500 is positioned on the hanger body 320. The straddling action of the lower neck indicator 500 on the hanger body 320 further enhances the stabilization of indicator by preventing the indicator from moving laterally.

The fourth flange 370 is properly distanced from the hook 310, such that, after the lower neck indicator 500 straddles on the hanger body, the inner surface 569 of the right end wall 560 engages the right sloped surface 372 of the fourth flange 370 of the hanger 300. The engagement between the right end wall 560 and the fourth flange 370 enhances the stabilization of the lower neck indicator 500 on the hanger 300 by preventing the indicator from moving horizontally.

Figure 14:
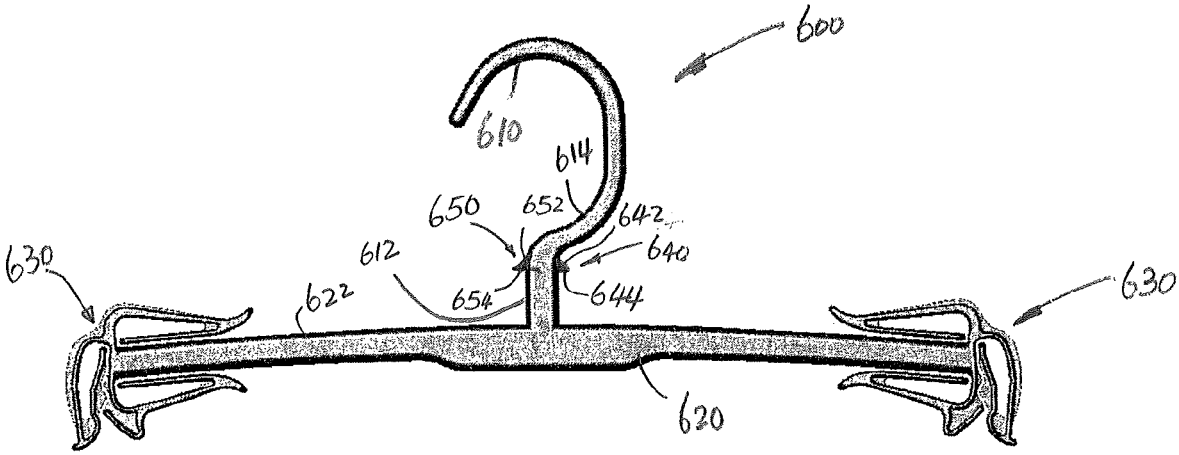
FIG. 14 is a front view of a garment hanger according to another exemplary embodiment of the present invention.
Figure 15:
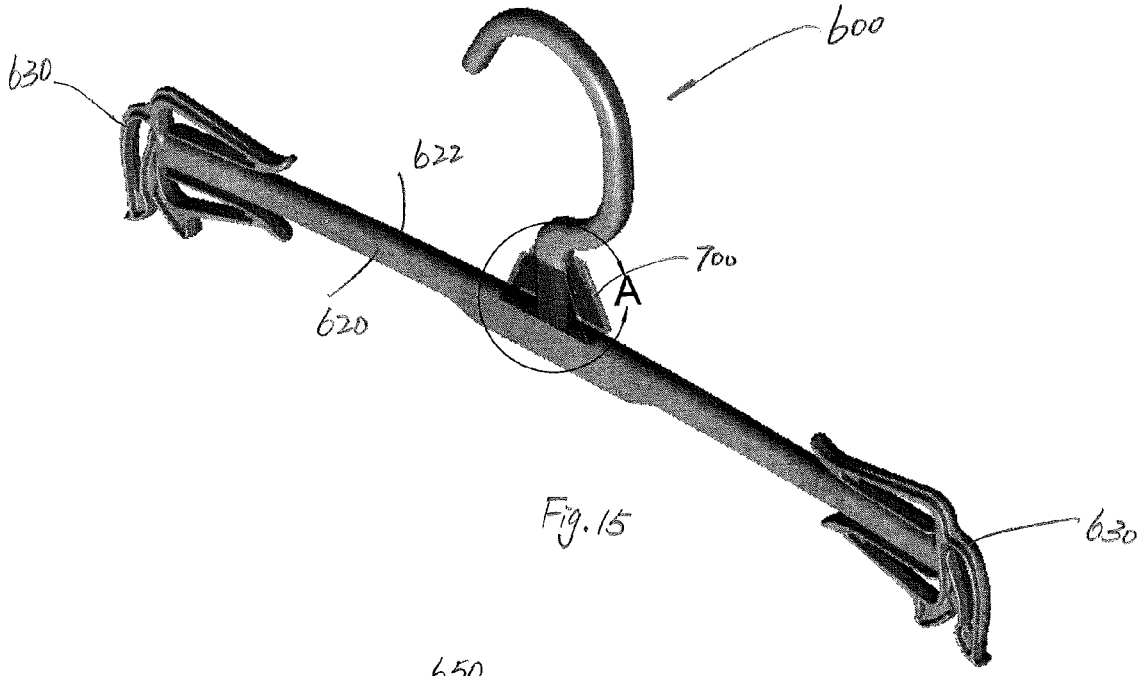
FIG. 15 is a perspective view of a combination of the garment hanger shown in FIG. 14 and a lower neck indicator attached to the hanger.

FIG. 14 is a front view of a garment hanger 600, according to another exemplary embodiment of the present invention. FIG. 15 is a perspective view of a combination of the garment hanger 600 and a lower neck indicator 700 attached to the hanger for showing garment related information, such as the size of the garment.

The hanger 600 includes a hook 610 and a hanger body 620 connected to the hook 610. The intersection of the hook 610 and the hanger body 620 defines a lower neck region A, where the lower neck indicator is attached to the hanger.

In this embodiment, the hook 610 includes an upright portion 612, which extends upwardly from the hanger body 620. Preferably, the upright portion 612 is substantially perpendicular to the top surface 622 of the hanger body 620. The hook 610 further includes a curved portion 614 formed integrally with the upright portion 612 during a molding process. The hanger 600 further includes a pair of composite garment retaining clips 630 disposed at either end of the hanger body 620, respectively.

A first flange 640 is formed at the right side of the hanger hook 610 and a second flange 650 is formed at the left side of the hanger hook 610. Preferably, the first flange 640 and the second flange 650 are formed symmetrically along the upright portion 612 of the hook. The first flange 640 includes a first sloped surface 642 extending downward and away from the hook 610 and a first undersurface 644 extending away from the hook 610. The first undersurface 644 provides indicator-retaining interference with the indicator 700 to retain the indicator at the lower neck region A. Preferably, the first undersurface 644 is substantially horizontal. Similarly, the second flange 650 includes a second sloped surface 652 extending downward and away from the hook 610 and a second undersurface 654 extending away from the hook 610. Preferably, the second undersurface 654 is substantially horizontal to positively retain the indicator at the lower neck region A.

Figure 16:
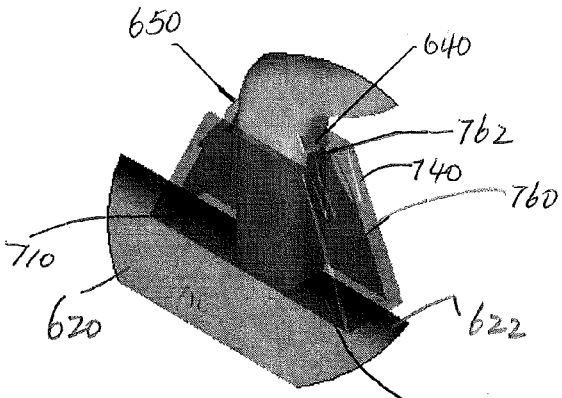
FIG. 16 is an enlarged perspective view of the lower neck region shown in FIG. 15.
Figure 17:
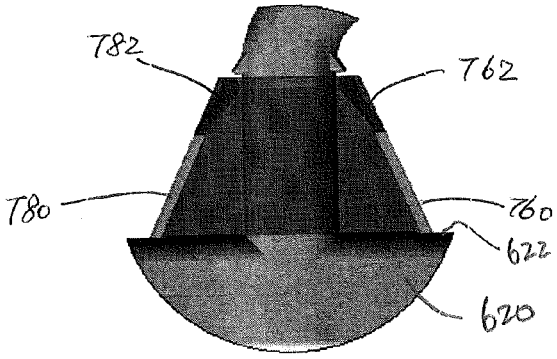
FIG. 17 is an enlarged front view thereof.

FIG. 16 is an enlarged perspective view of the lower neck region A shown in FIG. 15, and FIG. 17 is an enlarged front view thereof.

As shown, the lower neck indicator 700 includes an indicator body 710 formed by an anterior sidewall 720, a posterior sidewall 740 and a pair of end walls 760, 780 connecting the sidewalls. The indicator body 710 defines a top opening and a bottom opening for admitting the hanger hook 610. The indicator 700 further includes a pair of resilient tabs 762 and 782, disposed in the end walls 760 and 780, respectively.

During operation, the first sloped surface 642 of the first flange 640 and the second sloped surface 652 of the second flange 650 deflect the first resilient tab 762 and the second resilient tab 782, respectively, to allow the indicator 700 to pass over the upright portion 612 of the hook 610 and sit on the top surface 622 of the hanger body 620. Subsequently, the first and second resilient tabs 762 and 782 return to their original configuration to place the tabs under the first flange 640 and the second flange 650, respectively. The engagement between the flanges and the resilient tabs prevents the indicator 700 from accidentally releasing from the hanger, thereby providing a "Child Proof" hanger and sizer.

In the shown embodiment, the lower neck indicator 700 sits on the hanger body in a stabilized manner. Alternatively, the indicator may include a pair of slots formed in the end walls, respectively, to provide a straddle sizer. Furthermore, the height of the indicator can be adjusted to accommodate different hanger styles, as long as the height is substantially complementary to that of the first and second flanges. For example, the indicator 700 shown in this embodiment is taller and narrower than the indicator 500 shown in the previous embodiment. In addition, the hook 610 can have a third flange and/or a fourth flange as shown in FIG. 10, for enhancing the stabilization of the indicator 700 on the hanger 600.

Figure 18:
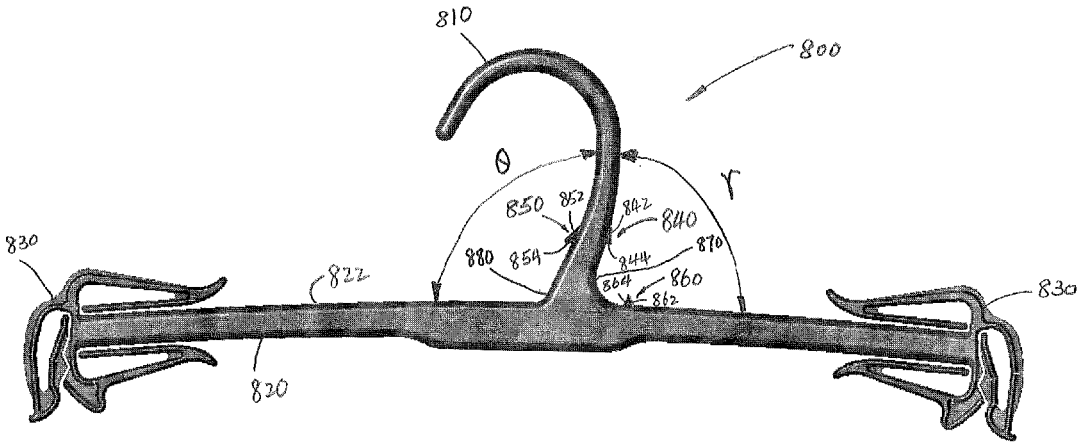
FIG. 18 is a front view of a garment hanger according to another exemplary embodiment of the present invention.
Figure 19:
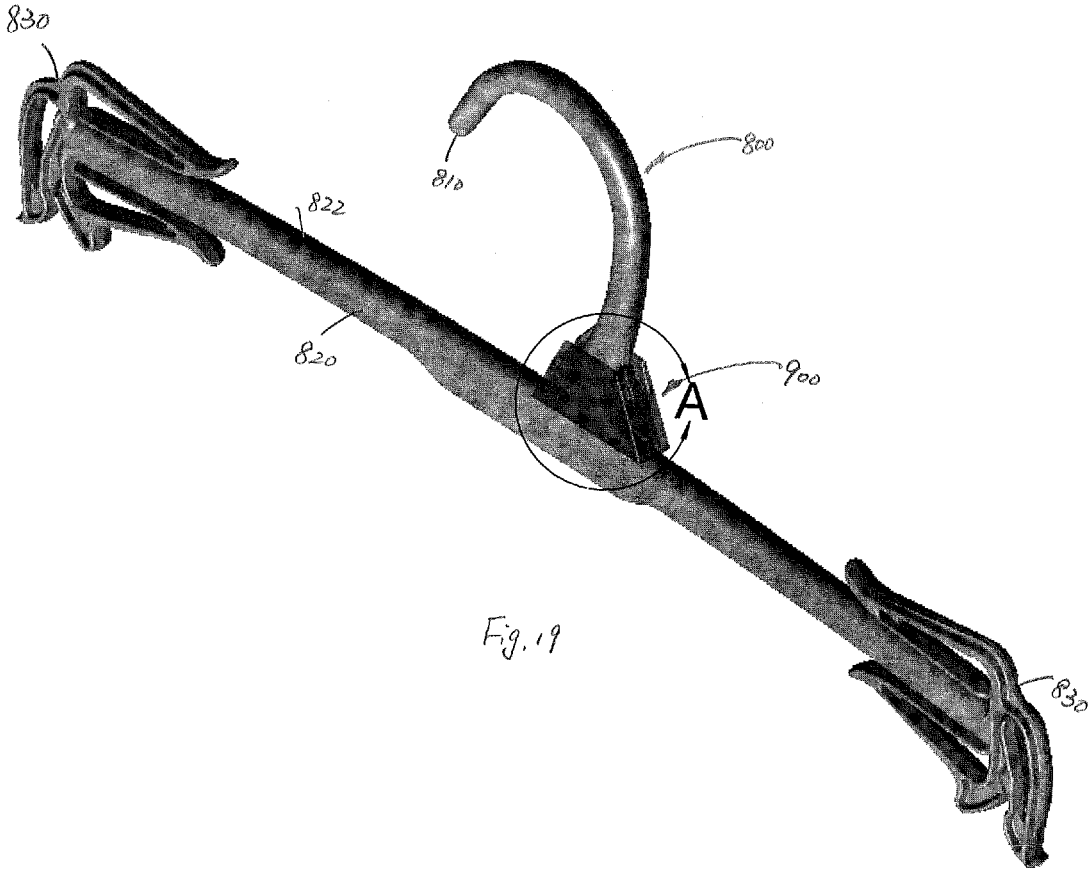
FIG. 19 is a perspective view of a combination of the garment hanger shown in FIG. 18 and a lower neck indicator attached to the hanger.

FIG. 18 is a front view of a garment hanger 800, according to another exemplary embodiment of the present invention. FIG. 19 is a perspective view of a combination of the garment hanger 800 and a lower neck indicator 900 attached to the hanger for showing garment related information, such as the size of the garment.

The hanger 800 includes a hook 810 and a hanger body 820 connected to the hook 810. The intersection of the hook 810 and the hanger body 820 defines a lower neck region A, where the lower neck indicator is attached to the hanger. The hanger 800 further includes a pair of composite garment retaining clips 830 disposed at either end of the hanger body 820, respectively.

The hanger 800 includes a first flange 840 formed at the right side of the hanger hook 810 and a second flange 850 formed at the left side of the hanger hook 810. Preferably, the first flange 840 and the second flange 850 are formed at a same height from the top surface 822 of the hanger body 820. The first flange 840 includes a first sloped surface 842 and a first undersurface 844, which is preferably substantially horizontal. The second flange 850 includes a second sloped surface 852 and a second undersurface 854, which is preferably substantially horizontal. The undersurfaces of the flanges operatively engage a pair of resilient tabs of the indicator 900, respectively, to retain the indicator at the lower neck region A.

In this embodiment, the hanger 800 further includes a third flange 860 disposed on the top surface 822 of the hanger body 820. The third flange 860 is shaped to have a substantially triangular profile extending upwardly from the top surface 822. The third flange 860 includes a first sloped surface 862 and a second sloped surface 864, extending oppositely with respect to each other. However, a person of ordinary skill in the art understands that the shape and profile of the third flange can vary without departing from the spirit of the present invention. For example, the third flange can have a curved profile having a curved surface.

Preferably, the hanger hook 810 is integrally molded with the hanger body 820, to provide an obtuse angle θ at one side of the hook 810 and an acute angle γ at the other side of the hook 810. A curve portion 870 is formed at one side of the hook 110 corresponding to the angle γ, and a substantially angular portion 880 is formed at the other side of the hook 110 corresponding to the angle θ, at the lower neck region A, to provide smooth transitions between the hook 810 and hanger body 820.

Figure 20:
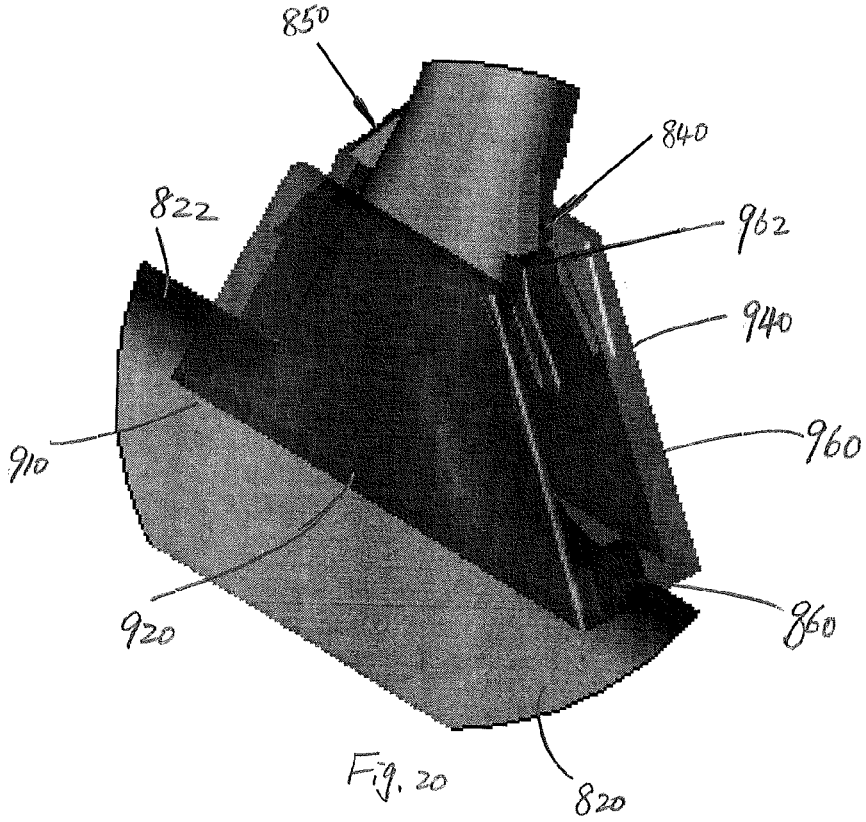
FIG. 20 is an enlarged perspective view of the lower neck region shown in FIG. 18.
Figure 21:
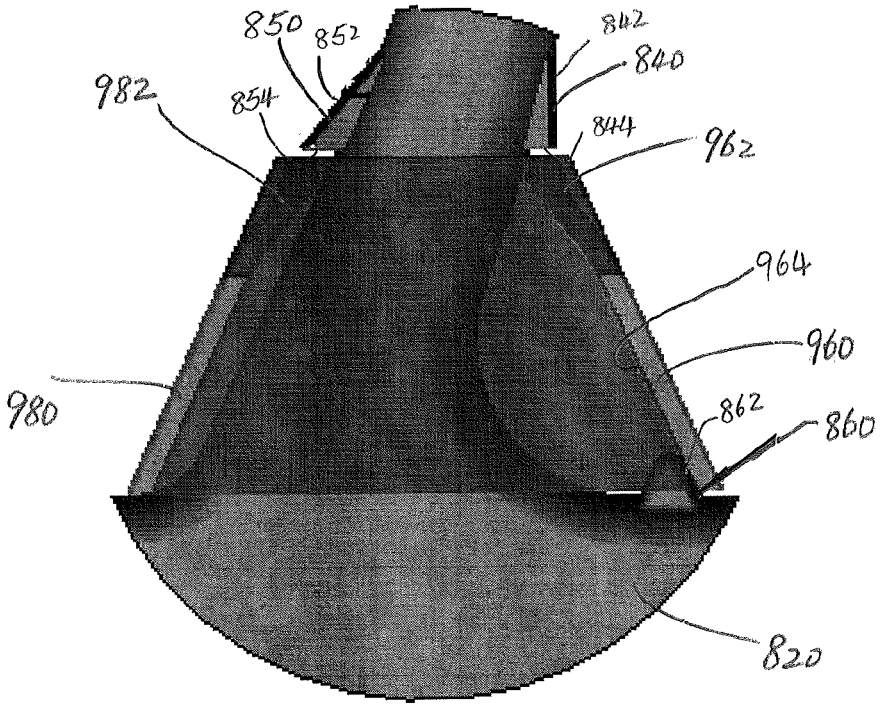
FIG. 21 is an enlarged front view thereof.

FIG. 20 is an enlarged perspective view of the lower neck region A shown in FIG. 18, and FIG. 21 is an enlarged front view thereof.

As shown, the lower neck indicator 900 includes an indicator body 910 formed by an anterior sidewall 920, a posterior sidewall 940 and a pair of end walls 960, 980 connecting the sidewalls. The indicator body 910 defines a top opening and a bottom opening for admitting the hanger hook 810. The indicator 900 further includes a pair of resilient tabs 962 and 982, disposed in the end walls 960 and 980, respectively.

During operation, the first sloped surface 842 of the first flange 840 and the second sloped surface 852 of the second flange 850 deflect the first resilient tab 962 and the second resilient tab 982, respectively, to allow the indicator 900 to pass over the hook 810 and sit on the top surface 822 of the hanger body 820. Subsequently, the first and second resilient tabs 962 and 982 return to their original configuration to place the tabs under the first flange 840 and the second flange 850, respectively. The engagement between the flanges and the resilient tabs prevents the indicator from accidentally releasing from the hanger, thereby providing a "Child Proof" hanger and sizer.

In addition, the third flange 860 is properly distanced from the hook 810, such that, after the indicator 900 sits on the hanger body, the inner surface 964 of the right end wall 960 engages the right sloped surface 862 of the third flange 860. The engagement between the right end wall 960 and the third flange 860 enhances the stabilization of the indicator 900 on the hanger 800 by preventing the indicator from moving horizontally.

In the shown embodiment, the indicator 900 sits on the hanger body in a stabilized manner. Alternatively, the indicator may include a pair of slots formed in the end walls, respectively, to provide a straddle sizer. Furthermore, the height of the indicator can be adjusted to accommodate different hangers styles, as long as the height is substantially complementary to that of the first and second flanges. For example, the indicator 900 shown in this embodiment is taller and narrower than the indicator 500 shown in the previous embodiment. In addition, the hook 810 can have a fourth flange similar to the third flange 360 of the hanger 300, as shown in FIG. 10, for further enhancing the stabilization of the indicator on the hanger.

The hanger and indicator combinations as shown in the previous embodiments can effectively prevent accidental and unintentional separation of the indicator from the hanger. Accordingly, the hanger and sizer according to the present invention is "Child Proof".

As is understood by a person of ordinary skill in the art, although the invention has been described and depicted by an intimate apparel hanger as an exemplary embodiment, the invention is not limited to the combination of an intimate apparel hanger and an indicator. But rather, without departing from the scope of the present invention, the present invention can be applied to any other type of hanger, including but not limited to, top garment hangers, pinch grip hangers, knit wear hangers, swim wear hangers, children's hangers, coordinate hangers, and so on. Specifically, as described and depicted herein, the lower neck indicator having a resilient tab, can be attached to any one of the foregoing hangers, which is provided with a complementary flange extending from the hook of the hanger to operatively engage the resilient tab so as to retain the indicator at the lower neck region of the hanger. Preferably, as described and depicted herein, the hanger flange includes a sloped surface for enlarging a top opening of the indicator to allow the indicator to pass over the hook, and an undersurface for retaining the indicator at the lower neck region of the hanger. Preferably, as described and depicted herein, the indicator further includes a secondary resilient tab and the hanger further includes a secondary complementary flange for engaging the secondary resilient tab. More preferably, the secondary resilient tab includes a sloped surface for enlarging a top opening of the indicator to allow the indicator to pass over the hook, and an undersurface for retaining the indicator at the lower neck region of the hanger. The first flange and the second flange, in concert with each other, prevent the indicator from moving vertically. Preferably, the hanger further includes a third complementary flange, as described and depicted herein, which is substantially enclosed by the indicator once the indicator sits on the hanger body. The third flange has an outer profile substantially engaging an interior of the indicator. Preferably, as described and depicted herein, the hanger has a curvature at the lower neck region thereof, opposite to the third flange. The third flange and the curvature, in concert with each other, prevent the indicator from moving horizontally. Further, the indicator preferably includes a pair of notches formed at the lower ends of the indicator, as described and depicted herein. By means of the notches, the indicator straddles laterally on the hanger body once the indicator sits on the hanger body, as described and depicted herein. The straddling configuration prevents the indicator from moving laterally.

The plastic hanger of the present invention can be formed of styrene, which provides a clear, virtually transparent hanger for maximum display of intimate apparel garments, such as bras and panties, to be suspended therefrom. In the alternative, the hanger can be molded from polypropylene, preferably H.I. styrene polypropylene, polyvinylchloride, ABS or other suitable thermoplastics and mixtures thereof. For additional reinforcement, K resin can be added to the plastic material.

From the foregoing illustrations it is readily apparent that the present invention is directed to an improved hanger and indicator combination suitable for industry mass production. The combination of the present invention offers reliable fixation between the hanger and the indicator, satisfying industry standards, such as, the VICS standards.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A combination comprising:

a hanger, comprising a hanger body and a hook extending upward from the body, the intersection of the hook and the hanger body defining a lower neck region of the hanger, the hanger further comprising at least a first flange projecting from the hook at a position distanced upward from the body of the hanger, the first flange having a first sloped surface extending downward and away from the hook and a first undersurface extending away from the hook; and an indicator for displaying information, the indicator positioned at the lower neck region below the first undersurface of the first flange, the indicator comprising an indicator body substantially surrounding the hook, the indicator further comprising a top opening and a bottom opening defined at the top side and the bottom side of the indicator, respectively, wherein the indicator body comprises a pair of opposing sidewalls connected by a pair of opposing end walls to provide a substantially trapezoidal profile of the indicator; and the indicator further comprises a pair of notches formed at the lower ends of the end walls, respectively, the notches being dimensioned to be substantially complementary to the width of the hanger body to at least partially accommodate the hanger body, thereby preventing the indicator from moving laterally; and wherein the first undersurface of the first flange provides indicator-retaining interference with the indicator to retain the indicator at the lower neck region.

2. The combination of claim 1, wherein the indicator further comprises at least a first resilient tab formed at the upper side of either a sidewall or an end wall, the first resilient tab defined by a first pair of slots substantially bounding the sides of the first tab.

3. The combination of claim 2, wherein the first resilient tab comprises a first free upper end configured to engage the first sloped surface of the first flange to enlarge the top opening of the indicator to allow the indicator to pass over the first flange, the first free upper end also configured to engage the first undersurface of the first flange once the indicator passes over the first flange to retain the indicator at the lower neck region of the hanger.

4. The combination of claim 3, wherein the first undersurface of the first flange is substantially horizontal.

5. The combination of claim 4, wherein the indicator further comprises a first horizontal lip extending inwardly from the first resilient tab at the first free upper end, the first lip configured to engage the first sloped surface of the first flange to enlarge the top opening of the indicator to allow the indicator to pass over the first flange and to engage the first undersurface of the first flange once the indicator passed over the first flange to retain the indicator at the lower neck region of the hanger.

6. The combination of claim 5, wherein the hanger further comprises a second flange projecting from the hook at a position distanced upward from the body of the hanger and opposite to the first flange, the second flange having a second sloped surface extending downward and away from the hook and a second undersurface extending away from the hook.

7. The combination of claim 6, wherein the indicator further comprises a second resilient tab opposite to the first resilient tab, the second resilient tab formed at the upper side of either a sidewall or an end wall opposite to the first resilient tab, the second resilient tab defined by a second pair of slots substantially bounding the sides of the second tab.

8. The combination of claim 7, wherein the second resilient tab comprises a second free upper end configured to engage the second sloped surface of the second flange to enlarge the top opening of the indicator to allow the indicator to pass over the second flange, the second free upper end also configured to engage the second undersurface of the second flange once the indicator passes over the second flange to retain the indicator at the lower neck region of the hanger.

9. The combination of claim 8, wherein the second undersurface of the second flange is substantially horizontal.

10. The combination of claim 9, wherein the indicator further comprises a second horizontal lip extending inwardly from the second resilient tab at the second free upper end, the second lip configured to engage the second sloped surface of the second flange to enlarge the top opening of the indicator to allow the indicator to pass over the second flange and to engage the second undersurface of the second flange once the indicator passed over the second flange to retain the indicator at the lower neck region of the hanger.

11. The combination of claim 6, wherein the hanger further comprises a third flange disposed below the first flange and enclosed by the body of the indicator once the indicator passes over the first flange, the third flange having a third sloped surface extending downward and away from the hook.

12. The combination of claim 11, wherein the third sloped surface of the third flange is configured to engage the inner side of the first resilient tab, thereby preventing the indicator from moving horizontally against the third flange.

13. The combination of claim 11, wherein the hook and the hanger body form an acute angle at one side of the hook and an obtuse angle at the other side of the hook and wherein the hook and the hanger forms a first curved portion at the lower neck region corresponding to the acute angle and a second curved portion at the lower neck region corresponding to the obtuse angle.

14. The combination of claim 11, wherein the hook and the hanger body form an acute angle at one side of the hook and an obtuse angle at the other side of the hook and wherein the hook and the hanger forms a curved portion at the lower neck region corresponding to the acute angle and a substantially angled portion at the lower neck region corresponding to the obtuse angle.

15. The combination of claim 11, wherein the hanger further comprises a fourth flange formed on the top surface of the hanger body, the fourth flange having a fourth sloped surface adapted to engage an inner surface of the indicator body.

16. The combination of claim 15, wherein the hook and the hanger body form an acute angle at one side of the hook and an obtuse angle at the other side of the hook and wherein the hook and the hanger forms a first curved portion at the lower neck region corresponding to the acute angle and a second curved portion at the lower neck region corresponding to the obtuse angle.

17. The combination of claim 15, wherein the hook and the hanger body form an acute angle at one side of the hook and an obtuse angle at the other side of the hook and wherein the hook and the hanger forms a curved portion at the lower neck region corresponding to the acute angle and a substantially angled portion at the lower neck region corresponding to the obtuse angle.

18. The combination of claim 6, wherein the hanger further comprises a fourth flange formed on the top surface of the hanger body, the fourth flange having a fourth sloped surface adapted to engage an inner surface of the indicator body.

19. The combination of claim 18, wherein the hook and the hanger body form an acute angle at one side of the hook and an obtuse angle at the other side of the hook and wherein the hook and the hanger forms a curved portion at the lower neck region corresponding to the acute angle and a substantially angled portion at the lower neck region corresponding to the obtuse angle.

20. The combination of claim 18, wherein the hook and the hanger body form an acute angle at one side of the hook and an obtuse angle at the other side of the hook and wherein the hook and the hanger forms a first curved portion at the lower neck region corresponding to the acute angle and a second curved portion at the lower neck region corresponding to the obtuse angle.

21. The combination of claim 6, wherein the hook comprises an upright portion and a curved portion, the upright portion being substantially perpendicular to the hanger body.

22. A garment hanger comprising:

a hanger body; and a hook extending upward from the hanger body, the intersection of the hook and the hanger body defining a lower neck region of the hanger where an indicator is attached to the hanger, wherein the hanger further comprises at least a first flange projecting from the hook at a position distanced upward from the body of the hanger, the first flange having a first sloped surface extending downward and away from the hook and a first undersurface extending away from the hook, the first undersurface of the first flange providing indicator-retaining interference with the indicator to retain the indicator at the lower neck region, wherein the hanger further comprises a second flange disposed below the first flange and distanced upwardly from the hanger body, the second flange having a second sloped surface extending downward and away from the hook, the second sloped surface being configured to operatively engage an inner surface of the indicator.

23. The hanger of claim 22, wherein the first undersurface of the first flange is substantially horizontal.

24. The hanger of claim 22, further comprising a third flange projecting from the hook at a position distanced upward from the body of the hanger and opposite to the first flange, the third flange having a third sloped surface extending downward and away from the hook and a second undersurface extending away from the hook.

25. The hanger of claim 24, wherein the second undersurface of the third flange is substantially horizontal.

26. The hanger of claim 22, wherein the hook and the hanger body form an acute angle at one side of the hook and an obtuse angle at the other side of the hook and wherein the hook and the hanger forms a first curved portion at the lower neck region corresponding to the acute angle and a second curved portion at the lower neck region corresponding to the obtuse angle.

27. The hanger of claim 22, wherein the hook and the hanger body form an acute angle at one side of the hook and an obtuse angle at the other side of the hook and wherein the hook and the hanger forms a curved portion at the lower neck region corresponding to the acute angle and a substantially angled portion at the lower neck region corresponding to the obtuse angle.

28. The hanger of claim 24, wherein the hanger further comprises a fourth flange formed on the top surface of the hanger body, the fourth flange having a fourth sloped surface adapted to engage an inner surface of the indicator body.

29. The hanger of claim 28, wherein the hook and the hanger body form an acute angle at one side of the hook and an obtuse angle at the other side of the hook and wherein the hook and the hanger forms a first curved portion at the lower neck region corresponding to the acute angle and a second curved portion at the lower neck region corresponding to the obtuse angle.

30. The hanger of claim 28, wherein the hook and the hanger body form an acute angle at one side of the hook and an obtuse angle at the other side of the hook and wherein the hook and the hanger forms a curved portion at the lower neck region corresponding to the acute angle and a substantially angled portion at the lower neck region corresponding to the obtuse angle.

31. The hanger of claim 24, wherein the hanger further comprises a fourth flange formed on the top surface of the hanger body, the fourth flange having a fourth sloped surface adapted to engage an inner surface of the indicator body.

32. The hanger of claim 31, wherein the hook and the hanger body form an acute angle at one side of the hook and an obtuse angle at the other side of the hook and wherein the hook and the hanger forms a first curved portion at the lower neck region corresponding to the acute angle and a second curved portion at the lower neck region corresponding to the obtuse angle.

33. The hanger of claim 31, wherein the hook and the hanger body form an acute angle at one side of the hook and an obtuse angle at the other side of the hook and wherein the hook and the hanger forms a curved portion at the lower neck region corresponding to the acute angle and a substantially angled portion at the lower neck region corresponding to the obtuse angle.

34. The hanger of claim 22, wherein the hook comprises an upright portion and a curved portion, the upright portion being substantially perpendicular to the hanger body.

35. An indicator, attached to a lower neck region of a hanger for displaying information, comprising:

a pair of opposing side walls connected by a pair of opposing end walls to provide a substantially trapezoidal indicator body substantially surrounding a hook of the hanger;

a top opening and a bottom opening defined by the side walls and end walls, at the top side and the bottom side of the indicator, respectively;

a pair of resilient tabs formed at the upper sides of the either the side walls or the end walls, each of the resilient tabs defined by a pair of elongated slots substantially bounding the sides of the resilient tabs, the resilient tabs each comprising a free upper end displaceable to enlarge the top opening of the indicator to allow the indicator to pass over the hook of the hanger; and a pair of notches formed at the lower ends of the end walls, respectively, the notches dimensioned to be substantially complementary to the width of the hanger body.

36. The indicator of claim 35, wherein the top opening is substantially in a horizontal plane and the bottom opening is substantially in a horizontal plane.

37. The indicator of claim 35, wherein the pair of resilient tabs each comprise a horizontal lip extending inwardly from the free upper ends of the resilient tab.

* * * * *